US007018116B2

(12) United States Patent
Tsuchiya et al.

(10) Patent No.: US 7,018,116 B2
(45) Date of Patent: Mar. 28, 2006

(54) ARMATURE, WIRE DOT PRINTER HEAD AND WIRE DOT PRINTER

(75) Inventors: Keishi Tsuchiya, Shizuoka (JP); Takahiro Kawaguchi, Mishima (JP); Yasunobu Terao, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/940,492

(22) Filed: Sep. 14, 2004

(65) Prior Publication Data

US 2005/0201799 A1 Sep. 15, 2005

(30) Foreign Application Priority Data

Mar. 12, 2004 (JP) ..... 2004-070485

(51) Int. Cl.
*B41J 2/27* (2006.01)

(52) U.S. Cl. ..... 400/124.23; 400/124.11

(58) Field of Classification Search ..... 400/124.23, 400/124.01, 124.11; 101/93.05, 93.29
See application file for complete search history.

(56) References Cited

U.S. PATENT DOCUMENTS

| | | | | |
|---|---|---|---|---|
| 4,552,064 | A | 11/1985 | Sanders, Jr. et al. | |
| 4,674,896 | A | 6/1987 | Yasunaga et al. | |
| 4,697,939 | A | 10/1987 | Ara | |
| 4,767,227 | A | 8/1988 | Mitsuishi et al. | |
| 4,881,832 | A * | 11/1989 | Mitsuishi et al. | 400/124.23 |
| 4,988,223 | A | 1/1991 | Hilkenmeier et al. | |
| 4,993,854 | A | 2/1991 | Sato | |
| 5,074,687 | A | 12/1991 | Gugel | |
| 5,137,377 | A * | 8/1992 | Ito et al. | 400/56 |
| 5,205,659 | A * | 4/1993 | Gugel et al. | 400/124.23 |
| 5,290,112 | A * | 3/1994 | Stempfle et al. | 400/124.23 |
| 6,513,997 | B1 * | 2/2003 | Terao | 400/124.01 |
| 6,698,956 | B1 | 3/2004 | Terao et al. | |
| 6,776,545 | B1 | 8/2004 | Terao | |
| 6,805,503 | B1 | 10/2004 | Tsuchiya et al. | |
| 6,848,843 | B1 | 2/2005 | Kawaguchi | |
| 2004/0170461 | A1 | 9/2004 | Kawaguchi | |

FOREIGN PATENT DOCUMENTS

| | | | |
|---|---|---|---|
| JP | 02-011336 | A | 1/1990 |
| JP | 7-22994 | B2 | 2/1990 |
| JP | 3-007351 | A | 1/1991 |
| JP | 3-39256 | A | 2/1991 |
| JP | 03-191036 | A | 8/1991 |
| JP | 3-288660 | A | 12/1991 |
| JP | 4-002639 | A | 1/1992 |
| JP | 4-31061 | A | 2/1992 |
| JP | 04-105945 | A | 4/1992 |

(Continued)

OTHER PUBLICATIONS

U.S. Appl. No. 10/655,281, Inventor: Kawaguchi, T., filing date: Sep. 3, 2003.

(Continued)

*Primary Examiner*—Minh Chau
(74) *Attorney, Agent, or Firm*—Frishauf, Holtz, Goodman & Chick, PC

(57) ABSTRACT

In order to enhance magnetic characteristic to realize a stabilized pivotal movement of an armature and to obtain magnetic characteristic required for high-speed printing, an armature according to the present invention has a magnetic circuit forming member formed by laminating plural plates to be provided on an arm, that supports a printing wire, for forming a magnetic circuit.

3 Claims, 4 Drawing Sheets

FOREIGN PATENT DOCUMENTS

| | | | |
|---|---|---|---|
| JP | 5-35288 | U | 5/1993 |
| JP | 6-218954 | A | 8/1994 |
| JP | 6-227000 | A | 8/1994 |
| JP | 07-125265 | A | 5/1995 |
| JP | 09-187972 | A | 7/1997 |
| JP | 09-314868 | A | 12/1997 |
| JP | 10-006537 | | 1/1998 |
| JP | 2833001 | B2 | 10/1998 |
| JP | 10-291330 | A | 11/1998 |
| JP | 2850673 | B2 | 11/1998 |
| JP | 11-78075 | A | 3/1999 |
| JP | 2944562 | A | 6/1999 |
| JP | 11-291524 | A | 10/1999 |
| JP | 2000-280497 | A | 10/2000 |
| JP | 2001-219586 | A | 8/2001 |

OTHER PUBLICATIONS

U.S. Appl. No. 10/655,894, Inventor: Kawaguchi, T., filing date: Sep. 4, 2004.

U.S. Appl. No. 10/764,642, Inventor: Kawaguchi, T., filing date: Jun. 26, 2004.

U.S. Appl. No. 10/940,362, Inventor: Kawaguchi, T. et al., filing date: Sep. 14, 2004.

U.S. Appl. No. 10/940,361, Inventor: Kawaguchi, K. et al., filing date: Sep. 14, 2004.

U.S. Appl. No. 10/940,432, Inventor: Kawaguchi, T. filing date: Sep. 14, 2004.

U.S. Appl. No. 10/940,338, Inventor: Kawaguchi, T. et al., filing date: Sep. 14, 2004.

U.S. Appl. No. 11/073,118, Inventor: Kawaguchi et al., filing date: Mar. 3, 2005.

U.S. Appl. No. 11/073,117, Inventor: Tsuchiya et al., filing date: Mar. 3, 2005.

U.S. Appl. No. 11/073,092, Inventor: Kawaguchi et al., filing date: Mar. 3, 2005.

U.S. Appl. No. 11/073,093, Inventor: Kawaguchi et al., filing date: Mar. 3, 2005.

* cited by examiner

ARMATURE, WIRE DOT PRINTER HEAD AND WIRE DOT PRINTER

CROSS REFERENCE TO RELATED APPLICATION

The present application is based on Japanese Priority Document 2004-70485 filed on Mar. 12, 2004 the content of which is incorporated herein by reference.

BACKGROUND OF THE INVENTION

1. Field of the Invention

The present invention relates to an armature, a wire dot printer head and a wire dot printer.

2. Description of the Prior Arts

There has been known a wire dot printer head wherein an armature with a printing wire connected thereto is pivoted between a printing position and a stand-by position, and when the armature is pivoted to the printing position, a tip of the wire is brought into collision with a printing medium to effect printing. In a certain wire dot printer head of this type, there has been proposed a device wherein a magnetic flux is produced by a coil around the armature to be pivoted for forming a magnetic circuit that causes the armature to be attracted from a stand-by position to a printing position to effect printing.

It has been known that, in the wire dot printer head described above, an eddy current loss is caused by a ripple (change) in a flux passing through the armature. In order to restrain the eddy current loss to prevent the deterioration in magnetic characteristic, there has been proposed a technique for forming an armature by laminating plural thin plate-like members (see Japanese Unexamined Patent Publication No. 11336/1990). The patent document 1 discloses that plural plate-like members are coupled together with an engagement to integrally form an armature. The space between these plural plate-like members is spot-welded to be joined together.

However, the armature disclosed in the Japanese Unexamined Patent Publication No. 11336/1990 is formed such that plural plate-like members are coupled together with an engagement, so that a gap is present between the adjacent plate-like members, thereby deteriorating adhesion. Further, it is difficult to decrease a dimensional tolerance at the engagement section, so that the adhesion goes on deteriorating. This reduces magnetic characteristic of the magnetic circuit, whereby the stabilized pivotal movement of the armature cannot be realized, and further, magnetic characteristic required for high-speed printing cannot be obtained. As a result, it is impossible to execute high-speed printing. In particular, the armature is required to be pivoted 2500 times per second between the printing position and the stand-by position with a recent increased printing speed. Therefore, the deterioration in the magnetic characteristic becomes an important problem.

SUMMARY OF THE INVENTION

The present invention is accomplished in view of the above-mentioned circumstance, and aims to realize a stabilized pivotal movement of an armature and to obtain magnetic characteristic required for high-speed printing.

An armature according to the present invention comprises an arm that holds a printing wire, and a magnetic circuit forming member mounted at the arm, the magnetic circuit forming member being formed by laminating plural flat plates for forming a magnetic circuit.

A wire dot printer head according to the present invention comprises the armature, a printing wire provided at the arm of the armature, a support member that pivotably supports the armature in the direction substantially parallel to the printing wire and a core provided at the position opposite to the magnetic circuit forming member of the armature in the pivotal direction of the armature, a coil being wound around the core.

A wire dot printer according to the present invention comprises the wire dot printer head, a platen opposite to the wire dot printer head, a carriage that holds the wire dot printer head and reciprocates along the platen and a printing medium transporting section that transports a printing medium between the wire dot printer head and the platen, wherein the wire dot printer head, the carriage and the printing medium transporting section are drive-controlled, to thereby effect printing based upon printing data.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiments for carrying out the present invention will be explained with reference to FIGS. 1 to 4.

[Wire Dot Printer Head]

Figure 1:
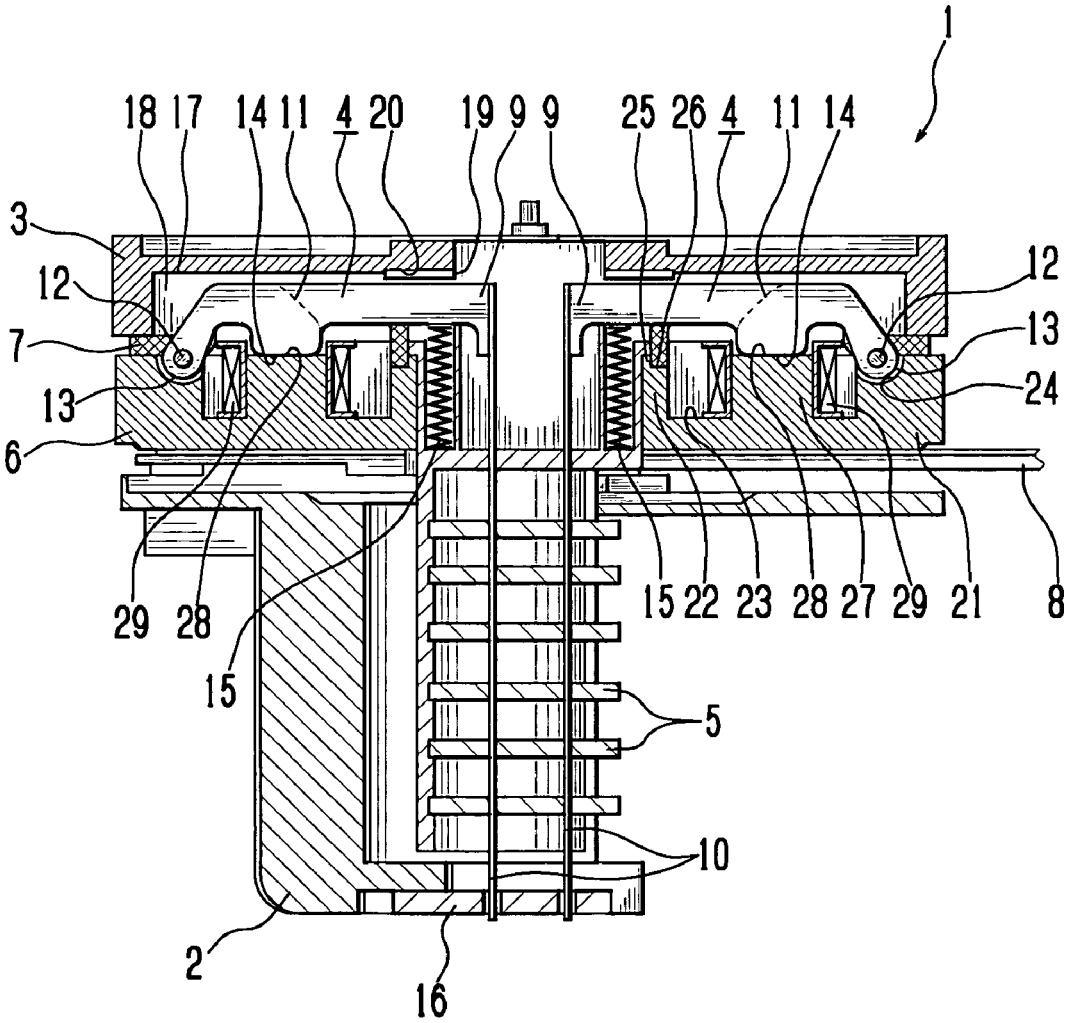
FIG. 1 is a front view in central vertical section of a wire dot printer head according to one embodiment of the present invention.
Figure 2:
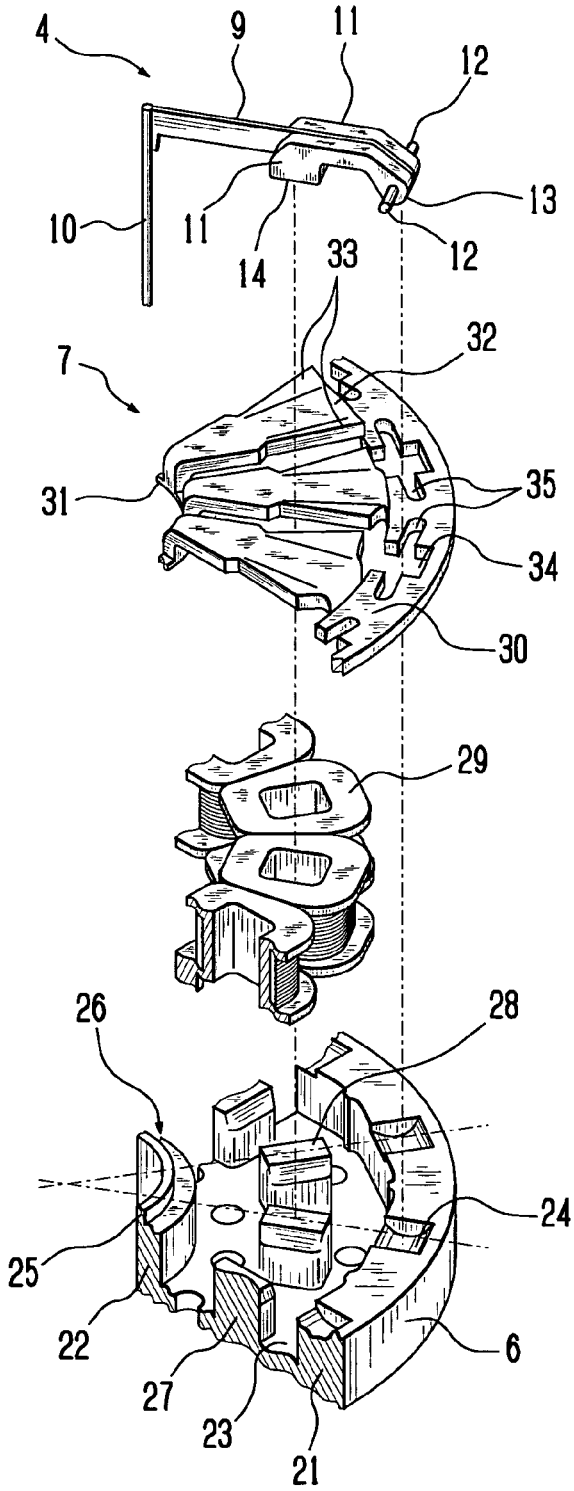
FIG. 2 is an exploded perspective view schematically showing a part of the wire dot printer head according to one embodiment of the present invention.
Figure 3:
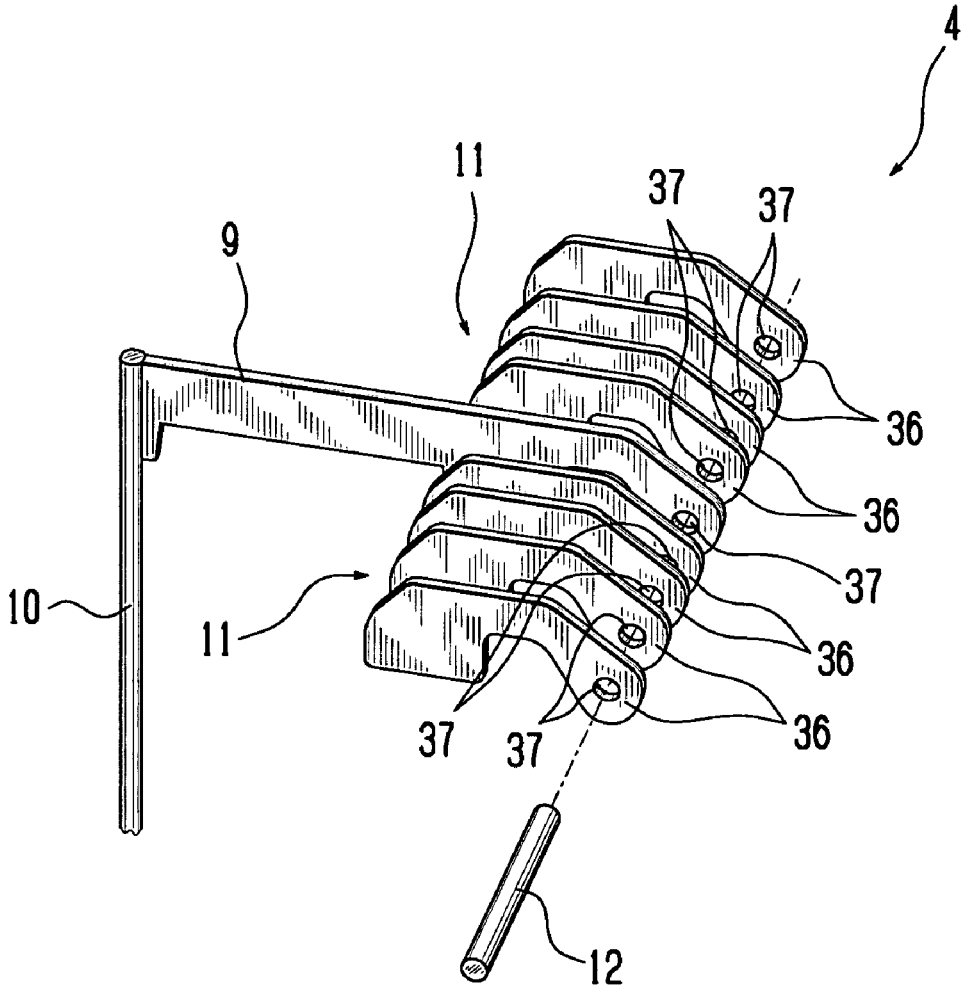
FIG. 3 is an exploded perspective view schematically showing an armature provided at the wire dot printer head according to one embodiment of the present invention.

Firstly, the entire construction of a wire dot printer head 1 will be explained with reference to FIGS. 1 to 3. FIG. 1 is a front view in central vertical section of a wire dot printer head 1 according to the embodiment and FIG. 2 is an exploded perspective view schematically showing a part of the wire dot printer head 1.

The wire dot printer head 1 has a front case 2 and a rear case 3 coupled together with a mounding screw, not shown. Disposed between the front case 2 and the rear case 3 are armatures 4, wire guides 5, yoke 6, armature spacer 7 and circuit board 8.

Each of the armatures 4 has an arm 9 that is formed into a plate-like shape and supports a printing wire (hereinafter simply referred to as a wire) 10 at one end thereof in the lengthwise direction (in the direction in which the arm 9 extends), magnetic circuit forming members 11 formed at both side faces of the arm 9 in the widthwise direction for forming a magnetic circuit and a pivot shaft 12 that is rendered to be a center of the pivot. The wire 10 is soldered to one end of the arm 9. An arc-shaped section 13 is formed at the other end of the armature 4. An attracted face 14 is formed at each of the magnetic circuit forming members 11. This attracted face 14 is positioned at the central section of the armature 4 in the lengthwise direction.

Plural armatures 4 described above are radially arranged with respect to the center of the yoke 6. Each of the armatures 4 is held at the surface of the yoke 6 such that it is pivotable in the direction away from the yoke 6 with the pivot shaft 12 as a center, and it is urged by an urging member 15 such as a coil spring toward the direction away from the yoke 6. The urging member 15 is provided for executing the urging operation.

Each of the wire guides 5 slidably guides the wire 10 for causing the tip of the wire 10 to strike against the predetermined position of a printing medium. Further, provided at the front case 2 is a tip guide 16 that aligns the tip of the wire 10 in a predetermined pattern and slidably guides the wire 10. It should be noted that the wire 10 moves to a position where the tip thereof strikes against the predetermined position, e.g., the printing medium such as a sheet or the like, with the pivotal movement of the armature 4, when the armature 4 pivots to the printing position.

A cylindrical section 18 having a bottom face section 17 at the side of one end is provided at the rear case 3. A mounting recess section 20 to which a metallic annular armature stopper 19 is attached is formed at the central portion of the bottom face section 17. The mounting of the armature stopper 19 is performed by fitting the armature stopper 19 into the mounting recess 20. When the armature 4 pivots from the printing position by the urging member 15, the arm 9 as part of the armature 4 comes into contact with the armature stopper 19, thereby stopping the pivotal movement of the armature 4. Therefore, the armature stopper 19 has a function for defining the stand-by position of the armature 4.

The circuit board 8 has a driving circuit for controlling the pivotal movement of the armature 4 between the printing position and the stand-by position. The driving circuit of the circuit board 8 selectively pivots an optional armature 4 among plural armatures 4 during the printing operation.

The yoke 6 is made of a magnetic material and has a pair of cylindrical sections 21 and 22 that are concentrically mounted, each having a different diameter. The size in the shaft direction (in the vertical direction in FIG. 1, i.e., in the shaft direction of the yoke 6) of each cylindrical section 21 and 22 is set equal to each other. The cylindrical section 21 at the outer periphery side and the cylindrical section 22 at the inner periphery side are formed integral by a bottom face 23 formed so as to close one end in the shaft direction. The yoke 6 is held between the front case 2 and the rear case 3 in a state in which its open side opposite to the bottom face 23 is opposed to an open, opposite end side of the rear case 3.

Formed at the outer periphery-side cylindrical section 21 are plural recesses 24 that are equal in number of the armatures 4. Each of the recesses 24 has the inner peripheral face formed into a concave shape having a curvature radius approximately same as that of the outer peripheral face of the arc-shaped section 13 of the armature 4. The arc-shaped section 13 formed at one end of the armature 4 is slidably fitted into the recess 24.

A fitted section 25 having an annular shape is provided at the inner periphery-side cylindrical section 22. The fitted section 25 is integrally provided with the inner periphery-side cylindrical section 22 so as to be positioned concentric with the inner periphery-side cylindrical section 22. The outer diameter of the fitted section 25 is set smaller than the outer diameter of the inner periphery-side cylindrical section 22. Accordingly, a step section 26 is formed at the inner periphery-side cylindrical section 22 by the fitted section 25.

Provided integral with the bottom face 23 are plural cores 27 annually arranged between the outer periphery-side cylindrical section 21 and the inner periphery-side cylindrical section 22. The size of each core 27 in the shaft direction of the yoke 6 is set equal to the size of each cylindrical section 21 and 22 in the shaft direction of the yoke 6.

A pole face 28 is formed at one end of each core 27 in the shaft direction of the yoke 6. The pole face 28 of the core 27 is formed so as to oppose to the attracted face 14 of the magnetic circuit forming member 11 provided at the armature 4. Moreover, a coil 29 is wound around the outer periphery of each core 27. Specifically, the yoke 6 has plural cores 27 annually arranged, each core having the coil 29 wound therearound. Although the winding directions of all coils are set equal to one another in this embodiment, the invention is not limited thereto. For example, coils having different winding directions may be selectively arranged.

The armature spacer 7 has a pair of ring-shaped members 30 and 31 having diameters approximately equal to the diameters of the cylindrical sections 21 and 22 of the yoke 6 and plural guide members 32 radially bridged between the ring-shaped members 30 and 31 so as to be positioned between the armatures 4. These guide members 32 form a side magnetic path with respect to the armature 4. The outer periphery-side ring-shaped member 30 and the inner periphery-side ring-shaped member 31 are concentrically provided.

When the armature spacer 7 is disposed on the yoke 6, the outer periphery-side ring-shaped member 30 and the inner periphery-side ring-shaped member 31 come in contact with the cylindrical sections 21 and 22 of the yoke 6, whereby the inner periphery-side ring-shaped member 31 is fitted to the fitted section 25. It should be noted that the inner diameter of the inner periphery-side ring-shaped member 31 is set equal to or slightly greater than the outer diameter of the fitted section 25.

Each guide member 32 has a side yoke section 33 extending substantially radially of the ring-shaped members 30 and 31 toward the direction away from the pole face 26 of the core 27 and in the oblique direction. This side yoke section 33 has a blade-like shape that is wider toward the outer periphery-side ring-shaped member 30 from the inner periphery-side ring-shaped member 31.

Since the armature spacer 7 has plural guide members 32 bridged between a pair of ring-shaped members 30 and 31, slit-like guide grooves 34 are ensured that are open along the radius direction of the ring-shaped members 30 and 31. Each guide groove 34 is formed to have a width such that the side yoke section 33 comes close to the associated magnetic circuit forming member 11 to such an extent that it does not obstruct the pivot movement of the armature 4.

Further, the guide groove 34 communicates with the outer periphery-side ring-shaped member 30. Formed at the guide groove 34 at the outer periphery-side ring-shaped member 31 is a bearing groove 35 that is a cut-out section open contiguously to the guide groove 34 at the position of both side faces of the guide groove 34 along the outer diameter direction of the ring-shaped member 30. The pivot shaft 12 of the armature 4 is fitted into this bearing groove 35, Specifically, the pivot shaft 12 of the armature 4 is held by the yoke 6 and the armature spacer 7 such that the armature 4 opposes to the core 27.

A pressing member, not shown, for pressing the pivot shaft 12 of each of the plural armatures 4 fitted into the bearing groove 35 is mounted on the armature spacer 7. The pressing member is a plate-like member for pressing the pivot shaft 12 of each of the plural armatures 4 by coupling the front case 2 and the rear case 3 with a mounting screw. This pressing member is annually formed so as not to hinder the pivotal movement of the armature 4.

The structure of the armature 4 will be explained here with reference to FIG. 3. FIG. 3 is an exploded perspective view schematically showing the armature 4.

The armature 4 has two magnetic circuit forming members 11 at the positions opposite to each other via the arm 9. These magnetic circuit forming members are formed by laminating plural plates 36. It should be noted that one magnetic circuit forming member 11 is formed by, for example, laminating four plates 36.

Formed at the magnetic circuit forming members 11, i.e., plates 36 is a through hole 37 into which the pivot shaft 12 serving as the center of the pivot of the armature 4 is inserted. Further, the through hole 37 into which the pivot shaft 12 is inserted is also formed at the arm 9 of the armature 4. The pivot shaft 12 is pivotably mounted to the through hole 37.

Each of the plates 36 is made of 1% SiFe material or PMD (permendule). Further, a hardening process is provided on the surface of each plate 36. The surface of each plate 36 is ground to ensure a predetermined value of flatness and surface roughness. On the other hand, the arm 9 is made of, for example, SK-5 plate material that is surface-hardened with a heat treatment and has a plate thickness of 0.20 mm.

The thickness of each plate 36 is smaller than the diameter of the through hole 37. For example, the thickness of each plate is 0.20 mm and the diameter of the through hole 37 is 0.9 mm. This prevents the deformation of each plate 36 during the pressing process in case where the through hole 37 is formed on each plate 36 by a pressing, whereby the through hole 37 can be precisely formed on each plate 36.

The armature 4 is formed such that four plates 36 are laminated, then, the arm 9 is laminated on these plates 36, and further four plates 36 are laminated on the arm 9. The laminated plural plates 36 and the arm 9 are integrally formed by performing laser welding in which laser beam is irradiated to the outer surface thereof along the laminating direction. However, the invention is not limited thereto. For example, the laminated plural plates 36 and the arm 9 may be integrally formed by winding alamido fiber around the outer surface thereof.

[Wire Dot Printer]

Figure 4:
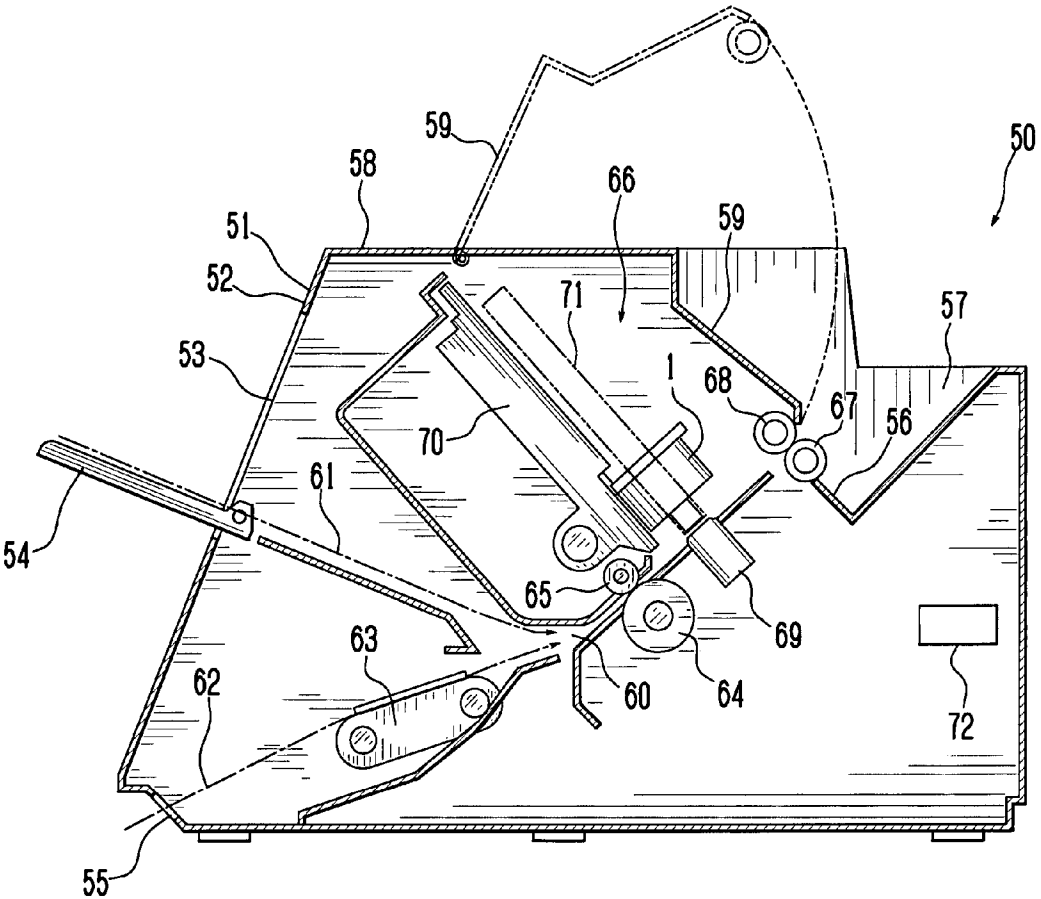
FIG. 4 is a longitudinal side view schematically showing a wire dot printer according to one embodiment of the present invention.

Subsequently explained with reference to FIG. 4 is a wire dot printer 50 provided with the wire dot printer head 1 described above. FIG. 4 is a longitudinal side view schematically showing the wire dot printer 50 according to the embodiment of the present invention.

The wire dot printer 50 has a housing case 51. An opening section 53 is formed at the front face 52 of the housing case 51. A manual tray 54 is mounted at the opening section 53 so as to be able to be opened and closed. Further, a paper feed port 55 is provided at the lower section of the front face 52 of the housing case 51, while a discharge tray 57 is provided at the back face side 56. Moreover, an open/close cover 59 is pivotably provided at the top face 58 of the housing case 51. The opened open/close cover 59 is shown by a virtual line in FIG. 4.

A sheet transporting path 60 that is a printing medium transporting path is provided in the housing case 51. The upstream side in the sheet transporting direction of the sheet transporting path 60 communicates with a paper feed path 61 arranged on the extended face of the opened manual tray 54 and a paper feed path 62 communicating with the paper feed port 55. The downstream side in the sheet transporting direction of the sheet transporting path 60 communicates with the discharge tray 57. A tractor 63 for transporting a sheet is provided in the sheet transporting path 62.

In the sheet transporting path 60, a transporting roller 64 and a pressing roller 65 are arranged so as to be opposite to each other, wherein the pressing roller 65 comes in pressed contact with the transporting roller 64. The transporting roller 64 and the pressing roller 65 transport a sheet that is a printing medium, and compose a sheet transporting section that is a printing medium transporting section. Further, disposed in the sheet transporting path 60 is a printer section 66 that performs a printing operation for the transported sheet. A discharge roller 67 is disposed at the inlet of the discharge tray 57. A pressing roller 68 that comes in pressed contact with the discharge roller 67 is pivotably supported at the side of a free end of the open/close cover 59.

The printer section 66 is composed of a platen 69 arranged in the sheet transporting path 60, a carriage 70 that can reciprocate along this platen 69 in the direction perpendicular to the sheet transporting path 60, the above-mentioned wire dot printer head 1 mounted on the carriage 70 and an ink ribbon cassette 71. It should be noted that the ink ribbon cassette 71 is removably mounted.

The carriage 70 is driven by a motor, not shown, to be reciprocated along the platen 69. The wire dot printer head 1 reciprocates in the main scanning direction with the reciprocating movement of the carriage 70 along the platen 69. Therefore, a head driving mechanism can be realized by the carriage 70 or motor in this embodiment. Further, the wire dot printer 50 has incorporated therein a driving control section 72 for controlling each section in the housing case 51. This driving control section 72 drive-controls each section of the printer section 66, tractor 63 and motor.

In this construction, when a single sheet is used as a sheet, it is fed from the manual tray 54. On the other hand, when plural sheets are continuously used, they are fed from the sheet feed port 55. Either sheet, not shown, is transported by the transporting roller 64, printed by the wire dot printer head 1 and discharged onto the discharge tray 57 by the discharge roller 67.

The printing is performed as follows. Specifically, the coil 29 is selectively excited in the wire dot printer head 1, whereby the armature 4 is attracted by the pole face 28 of the core 27 to be pivoted about the pivot shaft 12, resulting in that the wire 10 is pressed toward the sheet on the platen 69 via the ink ribbon, not shown. When the coil 29 is de-energized, the armature 4 returns under the urging force of the urging member 15 and stops at the stand-by position by the armature stopper 19. Although a sheet is used here as the printing medium, the invention is not limited thereto. For example, a pressure-sensitive color-developing paper can be used in which the color development occurs at the pressurized section. In case where the pressure-sensitive color-developing paper is used as the printing medium, the color development occurs at the section pressurized by the pressure of the wire 10 provided at the wire dot printer head 1, to thereby execute the printing.

Upon performing the printing operation by the wire dot printer 50, a coil 20 is selectively energized based upon the printing data by the control of the driving control section 72. Then, a magnetic circuit is formed among the core 27 on which the selected coil 29 is mounted, the magnetic circuit forming members 11 of the armature 4 opposed to the core 27, a pair of side yoke sections 33 opposed to the magnetic circuit forming members 11, guide members 32, the outer- and inner-periphery side cylindrical portions 21, 22 of the yoke 6, the bottom face 23 and again the core 27.

The formation of this magnetic circuit generates attraction force that attracts the magnetic circuit forming members 11 to the pole face 28 of the core 27 between the attracted face 14 of the magnetic circuit forming member 11 and the pole face 28 of the core 27. This attraction force allows the armature 4 to pivot about the pivot shaft 12 in the direction in which the attracted face 14 of the magnetic circuit forming member 11 is attracted to the pole face 28 of the core 27. It should be noted that the position where the attracted face 14 of the magnetic circuit forming member 11 of the armature 4 comes in contact with the pole face 28 of the core 27 is defined as the printing position in this embodiment.

As a result of the pivotal movement of the armature 4 to the printing position, the tip of the wire 10 projects to the side of the sheet. Since the ink ribbon is interposed between the wire dot printer head 1 and the sheet at this time, the pressure from the wire 10 is transmitted to the sheet via the ink ribbon and the ink from the ink ribbon is transferred onto the sheet, thereby carrying out the printing.

When the coil 29 is de-energized, the magnetism so far developed becomes extinct, so that the magnetic circuit also vanishes. Consequently, the attractive force for attracting the magnetic circuit forming member 11 to the pole face 28 of the core 27 disappears, so that the armature 4 is urged away from the yoke 6 with an urging force of the urging member 15 and pivots about the pivot shaft 12 toward the stand-by position. The armature 4 pivots toward the stand-by position until its arm 9 comes into contact with the armature stopper 19, whereupon the armature is stopped at the stand-by position.

The printing operation described above is performed at high speed (for example, the printing speed of 2500 times per second). In this case, the armature 4 pivots between the printing position and the stand-by position with 2500 times per second. Since the magnetic circuit forming members 11 of the armature 4 are formed by laminating plural plates 36 (see FIG. 3), an eddy current loss can be restrained. Further, the laminated plural plates 36 are perfectly adhered without a gap. This enhances magnetic characteristic, thereby being capable of realizing a stabilized pivotal movement of the armature and further capable of obtaining magnetic characteristic required for high-speed printing. As a result, high-speed printing can be realized.

In this embodiment, each plate 36 has the through hole 37 into which the pivot shaft 12 serving as the center of the pivot is inserted, wherein the thickness of each plate 36 is smaller than the diameter of the through hole 37. Therefore, in case where the through hole 37 is formed on the plate 36 by a pressing, the plate 36 is not deformed during the pressing operation, thereby being capable of precisely forming the through hole 37 on the plate 36.

Further, the wire dot printer head 1 in this embodiment is provided with the above-mentioned armature 4, the wire 10 provided at the arm 9 of the armature 4, the yoke 6 and the armature spacer 7 that are supporting members for pivotably supporting the armature 10 in the direction substantially parallel to the wire 10 and the core 27 provided at the position opposite to the magnetic circuit forming member 11 of the armature 4 in the pivotal direction of the armature 4 in which the coil 29 is wound around the core 27. Therefore, magnetic characteristic required for high-speed printing can be obtained, thereby being capable of realizing high-speed printing.

Moreover, the wire dot printer 50 in this embodiment is provided with the above-mentioned wire dot printer head 1, platen 69 opposite to the wire dot printer head 1, carriage 70 that holds the wire dot printer head 1 and reciprocates along the platen 69 and transporting roller 64 and the pressing roller 65 serving as the printing medium transporting section for transporting a printing medium between the wire dot printer head 1 and the platen 69, wherein the wire dot printer head 1, carriage 70, transporting roller 64 and the pressing roller 65 are drive-controlled to effect printing based upon printing data. Therefore, magnetic characteristic required for high-speed printing can be obtained, thereby being capable of realizing high-speed printing.

Obviously, numerous modifications and variations of the present invention are possible in light of the above teachings. It is therefore to be understood that within the scope of the appended claims, the invention may be practiced otherwise than as specifically described herein.

What is claimed is:

1. An armature comprising:

an arm that holds a printing wire; and a magnetic circuit forming member which is formed by laminating a plurality of plates and which is provided on the arm for forming a magnetic circuit;

wherein each of the plates has a through hole into which a pivot shaft serving as a center of a pivot is inserted; and wherein a thickness of each plate is smaller than a diameter of the through hole.

2. A wire dot printer head, comprising:

(a) an armature comprising:

an arm; and a magnetic circuit forming member which is formed by laminating a plurality of plates and which is provided on the arm for forming a magnetic circuit;

wherein each of the plates has a through hole into which a pivot shaft serving as a center of a pivot is inserted; and wherein a thickness of each plate is smaller than a diameter of the through hole;

(b) a printing wire held by the arm of the armature;

(c) a support member that pivotably supports the armature in a pivotal direction substantially parallel to the printing wire; and (d) a core mounted at a position opposite to the magnetic circuit forming member of the armature in the pivotal direction of the armature, a coil being wound around the core.

3. A wire dot printer comprising:

(i) a wire dot printer head comprising:

(a) an armature comprising:

an arm; and a magnetic circuit forming member which is formed by laminating a plurality of plates and which is provided on the arm for forming a magnetic circuit;

wherein each of the plates has a through hole into which a pivot shaft serving as a center of a pivot is inserted; and wherein a thickness of each plate is smaller than a diameter of the through hole;

(b) a printing wire held by the arm of the armature;

(c) a support member that pivotably supports the armature in a pivotal direction substantially parallel to the printing wire; and (d) a core mounted at a position opposite to the magnetic circuit forming member of the armature in the pivotal direction of the armature, a coil being wound around the core;

(ii) a platen opposite to the wire dot printer head;

(iii) a carriage that holds the wire dot printer head and reciprocates along the platen;

(iv) a printing medium transporting section that transports a printing medium between the wire dot printer head and the platen; and (v) a unit that drive-controls the wire dot printer head, the carriage and the printing medium transporting section, to thereby effect printing based upon printing data.

* * * * *